United States Patent [19]

Ota et al.

[11] Patent Number: 4,496,246

[45] Date of Patent: Jan. 29, 1985

[54] TIMEPIECE CONSTRUCTION

[75] Inventors: Tomio Ota; Mamoru Miyasaka; Imao Hiraga, all of Suwa, Japan

[73] Assignee: Kabushiki Kaisha Suwa Seikosha, Tokyo, Japan

[21] Appl. No.: 313,109

[22] Filed: Oct. 20, 1981

[30] Foreign Application Priority Data

Oct. 21, 1980 [JP] Japan ..... 55-147448
Nov. 7, 1980 [JP] Japan ..... 55-157192

[51] Int. Cl.[3] ..... G04B 00/00

[52] U.S. Cl. ..... 368/88; 368/300; 368/322; 368/220; 368/76

[58] Field of Search ..... 368/28, 34, 35, 37, 368/88, 316, 317, 300, 322–324, 220, 176

[56] References Cited

U.S. PATENT DOCUMENTS

| | | | |
|---|---|---|---|
| 3,324,646 | 6/1967 | Schneider | 368/220 |
| 3,397,531 | 8/1968 | DuBois | 368/324 |
| 4,024,677 | 5/1977 | Meister et al. | 58/23 |
| 4,027,468 | 6/1977 | Felty | 368/35 |
| 4,127,984 | 12/1978 | Ogihara et al. | 368/322 |
| 4,175,374 | 11/1979 | Yoshizawa | 368/300 |
| 4,217,753 | 8/1980 | Loretan | 368/324 |
| 4,234,943 | 11/1980 | Teramoto et al. | 368/37 |
| 4,249,251 | 2/1981 | Wuthrich | 368/220 |
| 4,250,576 | 2/1981 | Sudler et al. | 368/324 |

FOREIGN PATENT DOCUMENTS

| | | | |
|---|---|---|---|
| 464804 | 4/1968 | Switzerland | 368/300 |

*Primary Examiner*—Bernard Roskoski
*Attorney, Agent, or Firm*—Blum, Kaplan, Friedman, Silberman & Beran

[57] ABSTRACT

A precision, reliable, analog timepiece uses plastic frame elements reinforced with metal, and plastic wheel and pinions pivoting in holes formed in the plastic of the frame elements. The plastic frame elements are separated into portions corresponding to the functional timepiece portions. Exposed areas of the reinforcing metal provide reference locations in molding the frame elements and for component mounting. The entire timepiece is assembled from one side of a base frame element.

10 Claims, 15 Drawing Figures

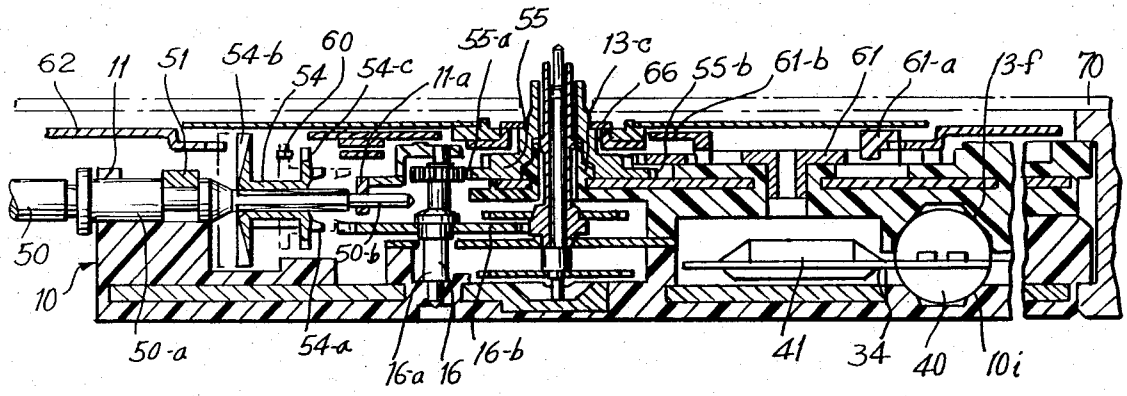
FIG. 5
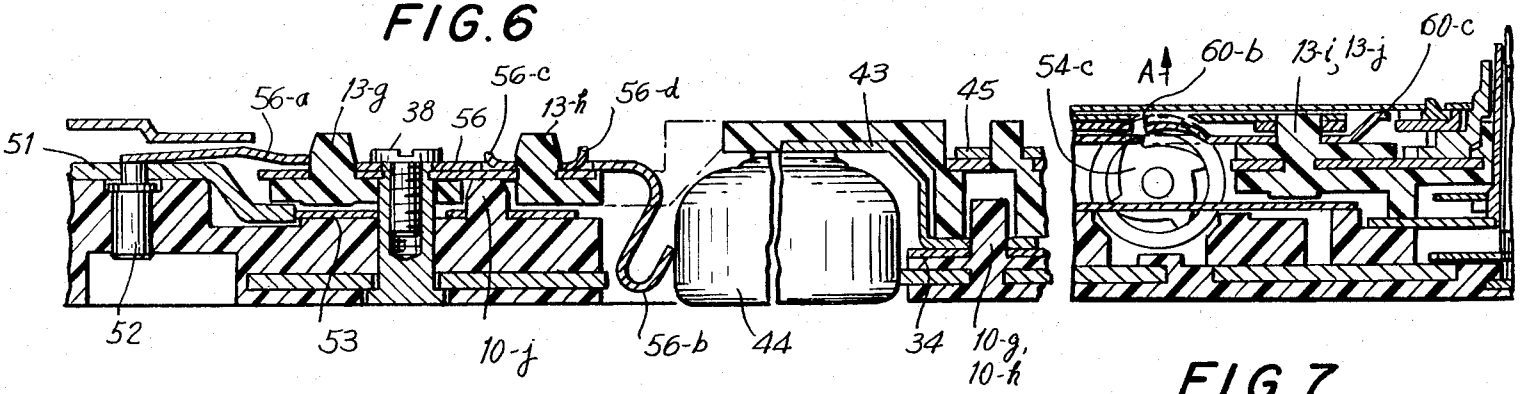
FIG. 6
FIG. 7

FIG. 14
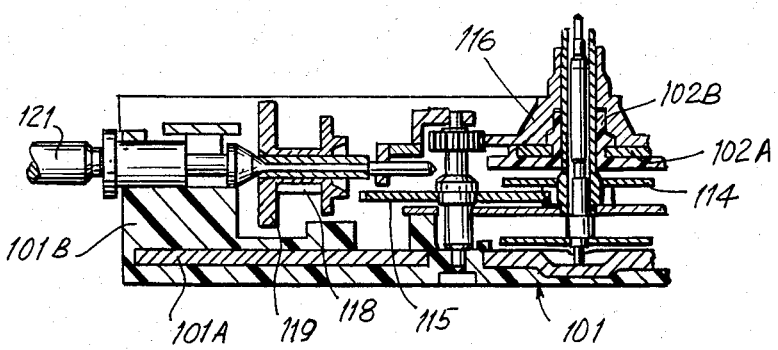
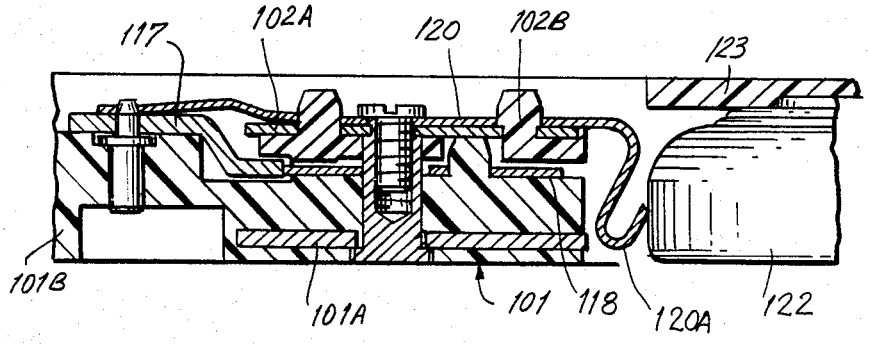
FIG. 15

TIMEPIECE CONSTRUCTION

BACKGROUND OF THE INVENTION

This invention relates generally to an electronic analog type timepiece and more particularly to the construction for an analog type timepiece using a metal reinforced plastic member for the bottom plate and as a bridge. In the prior art, metal members have generally been applied to every major part of an analog type timepiece, such as the bottom plate or bridges, etc. The use of plastic members has been limited to portions of the calendar components and parts for the purpose of insulation in the electronic circuit. Even if using a plastic member for the bottom plate, it is conventional to use a metal component for the parts requiring high precision such as related to the gear train mechanism. Therefore, the advantages of plastic components have not been sufficiently applied in practical applications. The excellent formability and low cost of plastic are qualities which have not yet been used advantageously in a reliable timepiece.

What is needed is an electronic analog timepiece using plastic in major elements and components and providing a precision product at low cost.

SUMMARY OF THE INVENTION

This invention relates generally to an analog electronic timepiece and more particularly to the mechanical construction of the timepiece. A precision, reliable, analog timepiece uses plastic frame elements reinforced with metal, and plastic wheel and pinions pivoting in holes formed in the plastic of the frame elements. The plastic frame elements are separated into portions corresponding to the functional timepiece portions. Exposed areas of the reinforcing metal provide reference locations in molding the frame elements and for component mounting. The entire timepiece is assembled from one side of a base frame element.

Accordingly, it is an object of this invention to provide an improved construction for an analog timepiece using major components fabricated of plastic.

Another object of this invention is to provide an improved construction for an analog type timepiece which provides for precision in assembly and uses major plastic components.

A further object of this invention is to provide an improved construction for an analog type timepiece which provides low friction characteristics as a result of the use of plastic components.

Still another object of this invention is to provide an improved construction for an analog timepiece wherein the parts are assembled entirely from one side.

Yet another object of this invention is to provide an improved construction for an analog type timpiece wherein the disadvantages of plastic for the frame, problems of strength, dimensional instability and warpage of plastic are eliminated by combining the properties of plastic and metal.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 5 through 7 are similar to FIG. 3 showing the setting and power portions of the timepiece;

FIG. 14 is partial sectional view of a setting mechanism portion of the timepiece of FIG. 12; and FIG. 15 is a partial sectional view of the setting mechanism and a battery portions of the timepiece of FIG. 12.

DESCRIPTION OF THE PREFERRED EMBODIMENTS

With reference to the Figures, the construction of an analog timepiece in accordance with this invention is described in the following order herein: first, the basic construction of the timepiece; second, the mechanisms for actuation and characteristics of the gear train, motor and electronic circuitry; thirdly, the mechanism and operating characteristics for setting of the timepiece and calendar portions of the timepiece.

Figure 1:
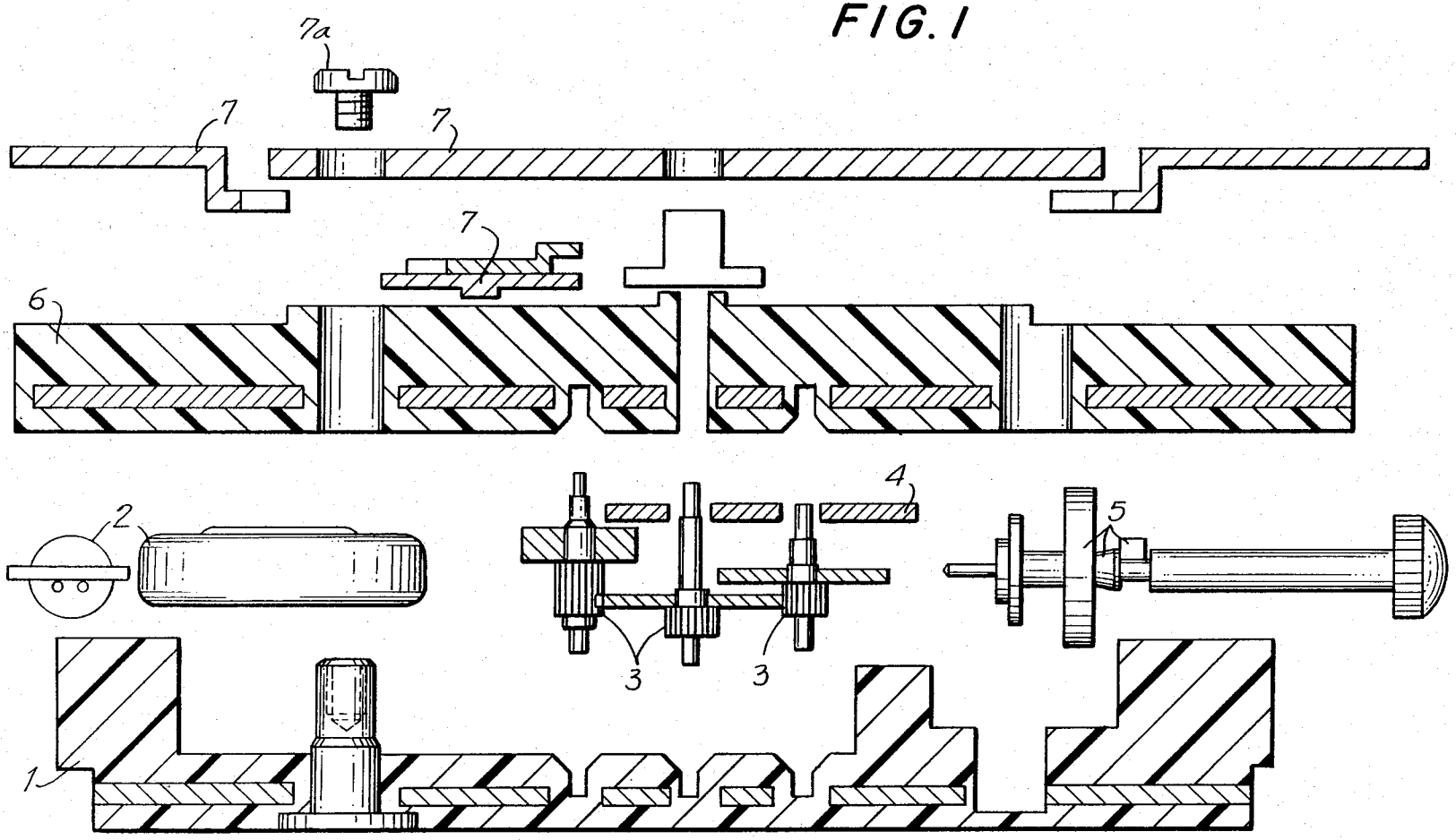
FIG. 1 is a semi-schematic exploded side sectional view of a basic timepiece in accordance with this invention.

First, the basic construction of an analog timepiece in accordance with this invention is shown in FIG. 1 and includes battery and circuit portions 2, a gear train and motor portion 3, a center wheel bridge 4 and a setting portion 5. These portions are located between a first frame, that is, a plate 1, which is the base of the timepiece, and a second frame, that is, a bridge 6. A calendar disk 7 is placed on the bridge 6 and the whole is held together by a screw *7a* which engages in a threaded post in the first frame plate 1. In accordance with this construction each component is put on one-by-one from one direction, that is, by using the part 1, known as a "bridge" in conventional timepieces, as the base for all parts. The first frame 1 and the second frame 6 are metal-reinforced plastic and the free-forming characteristic of plastic is utilized to prevent the tilt of each part. Also, assembly of each part is made simple by tapered hole inlets. Another characteristic of plastic is a low friction characteristic which is used to eliminate the need for oiling at the contacting portions of rotating and sliding members.

The gear train portion 3, which requires precision of center distances and a small degree of shaking, is concentrically positioned at the center portion of the timepiece. A rigid construction is applied to this gear train portion 3 and the resistance to deformation is improved by using a metal member as the center wheel bridge 4. On the other hand, a flexible construction is used at the circuit portion 2 and at the periphery where tightening forces are applied so that the deformation of the plastic is utilized in a positive manner. Thus, the basic construction of a timepiece in accordance with this invention as illustrated semi-schematically in FIG. 1 takes advantage of the best characteristic of both metal and plastic.

The mechanism, actuation and operating characteristics of the gear train, motor and circuit elements are now described with reference to the more detailed example of an analog timepiece construction as represented in FIGS. 2–8. A plate 10 comprised of a single metal plate 8 combined integrally with a plastic portion 9, forms the base, and the gear train portion is rotatably supported in the base 10 by bearing portions 10*a*,10*b*, etc., that is, holes for receiving pinion pivots. A bridge 13 includes a single metal plate 11 formed integrally with a plastic portion 12 and bearing portions 13*a*,13*b*, etc., to provide upper support for the gear train.

The gear train mechanism comprises a fifth wheel and pinion 14, a third wheel and pinion 15, a minute wheel 16, a center wheel and pinion 19, all rotatably supported by a center wheel bridge 6'. The center wheel bridge 6' is positively positioned by the tubes 17,18 extending between the plate 10 and the bridge 13 which are used to receive bridge screws 21,22. The center wheel and pinion 19 is also supported by a pipe portion 13*c* extending from the body of the bridge 13. The gear train also includes a fourth wheel and pinion 20 having its lower pivot rotatably supported by a bearing portion 10*c* of the plate 10 and the upper pivot being rotatably supported by a center bore 19*a* which passes through the center of the shaft of the wheel and pinion 19.

In this embodiment, the pointed end of the lower pivot 20*a* of the fourth wheel and pinion 20 abuts a recessed portion 8*a* formed (FIG. 3) in the basically flat metal plate 8 of the metal/plastic baseplate 10 in order to prevent a plastic bearing from breakdown due to the load produced when setting up a second hand. The amount of shake at the position 20*b* of the fourth wheel and pinion 20 is determined by the end 19*b* of the lower pivot of the center wheel pinion 19. Because the center wheel bridge 6' also serves as a guide for assembling the gear train, it is provided with guide holes 6*a*,6*b*,6*c* having a minimum clearance around each gear train component and including beveled surfaces 6*d*,6*e* for assisting in an easy incorporation of each part during the assembly. Beveled, countersunk surfaces, for example, surfaces 10*a*,13*a* are also formed into bearing portions in the plate 10 and in the bridge 13 to aid in assembly. The size and angle of the sloping surfaces are designed so as to include the range of angles wherein the gear train components are tilted at the time of assembly.

With reference to the circumference of the gear train, locating surfaces, for example, 10*d*,13*d* are formed to surround the center wheel bridge 6' and the upper, lower and center elements 13,10,6', respectively are screwed down and held together by through screws 21,22. As a result, shake in the gear train is not easily varied and further, the gear train portion has the property of high stiffness against forces tending to distort the bottom plate 10 from the outside of the timepiece. As for the center wheel and pinion 19, the center wheel 19*c* and the center pinion 19*d* are connected to each other by friction so that when the minute wheel 16 (FIG. 2) is rotated by a clutch wheel of the setting portion, as described hereinafter, to set a hand on the face of the timepiece, the force is not transmitted to the motor portion.

Next described is the motor portion which comprises a rotor 25 rotatably supported by upper and lower jewel bearings 23,24 having holes therethrough and retained in the plastic portions of the bottom plate 10 and in the bridge 13. The motor portion also includes a stator 27, which is aligned in its proper position by tubes 26,17 which receive the bridge screws 37,21, respectively, and a coil 29 held between the tubes 26,28 which receive the bridge screws 37,36, respectively, and a magnetic shielding plate 30. As is well known, the pulse motor is driven through a certain rotational angle by a driving pulse applied, for example, each second. In the embodiment shown, the jewel bearing 24 for the upper pivot of the rotor 25 is provided with an oil storing recessed portion 24*a* directly toward the inside of the timepiece. This makes it possible to easily insert the rotor by utilizing the sliding surface of the recessed portion during assembly. The jewel bearings 23,24 are driven into stepped holes in the bottom plate 10 and in the bridge 13 so as not to slip out of position when pushed upon during assembly of the timpiece. The outside of the stepped holes are provided with slanting surfaces 10*e*,13*e* as an aid for easy oiling of the bearings. The jeweled bearings are driven into the stepped holes until their top surfaces (FIG. 3) are substantially horizontally coplanar with the height of the adjacent reinforcement metal plate 8,11 of the bridge 10,13. Thereby, the jewel bearings 23,24 are prevented from slipping out of position when the plastic member 9,12 is distorted by creep and the like since the distance from the associated metal plate 8,11 is minimal.

Figure 3:
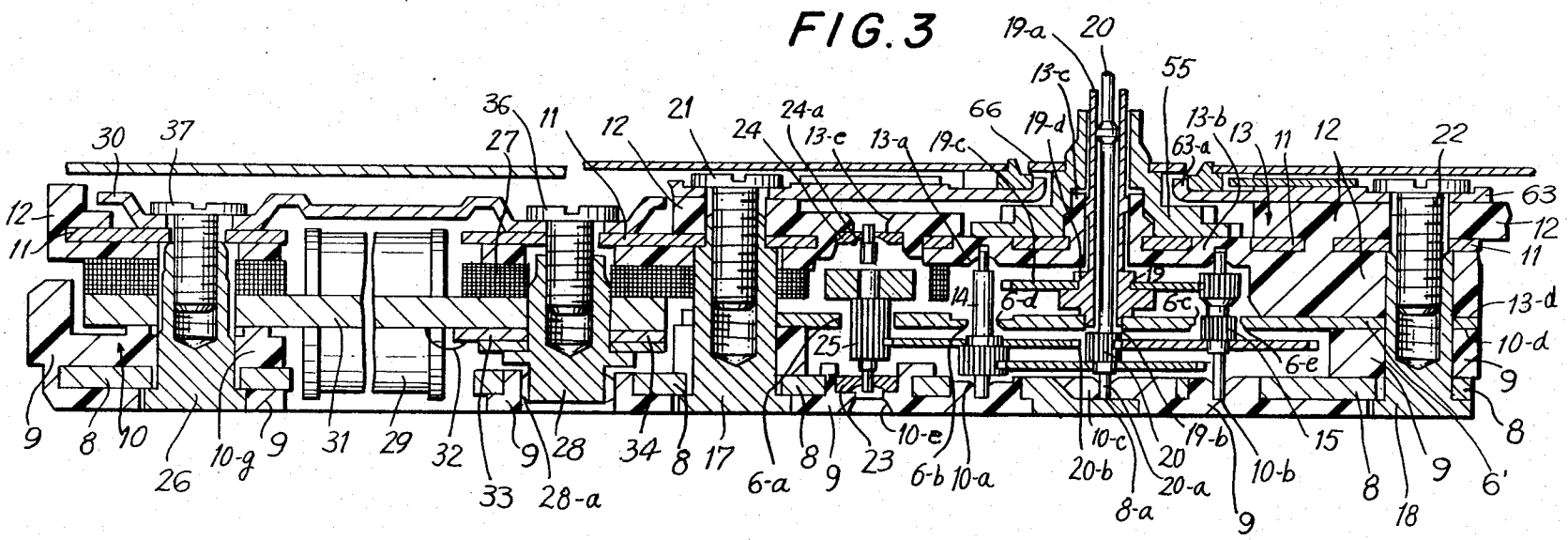
FIG. 3 is an enlarged cross-sectional partial view of the timepiece of FIG. 2 showing a gear train and motor construction.

As for the coil 29, a thin conductive wire 32 is wound on the magnetic core 31 and an end of the conductive wire is led to a coil plate 33. The coil plate 33 is pressed upon so as to be electrically connected to an output terminal portion of a circuit block 34 described hereinafter by means of the tube 28 and engaging bridge screw 36. As best seen in FIG. 3, the tube 28 for the bridge screw 36 is constructed so that a knurling tool portion 28*a* is provided. Thereby, the tube 28 for the bridge screw is driven and press fitted into the bottom plate 10, and the tube 28 for the bridge screw can be drawn out in the direction of the bridge. When tightening the bridge screw 36, even if the thicknesses of the stator 27, magnetic core 31, coil lead plate 33, circuit substrate 34, etc. may vary, the tube 28 for the bridge screw lifts up from the hole in the bottom plate 10, whereby each part, that is, the stator, core, etc., is firmly settled between a collar portion of the tube 28 for the bridge screw and the magnetic shielding plate 30 or between the reinforcement metal plate 11 for the bridge 13. Similarly, for the tube 26 for bridge screw 37, to fix the plastic portion, stator 27 and magnetic core 31, a plurality of convex portions or pads, 10*g* are formed on the bottom plate 10 in order to absorb the tolerance variations and to prevent the generation of a gap when the thickness of the parts between the plates 10,13 varies through normal production variations. When tightening the bridge screw 37, the reinforcement metal plate 11 for the bridge 13 is pressed upon until it touches the end of the tube 26 for the bridge screw connected to the bottom plate 10. In the process of tightening the screw 37, the convex portions 10*g*, which are made intentionally a little higher than ultimately desired, are crushed to prevent generation of a gap between the stator 27 and the magnetic core 31.

Figure 2:
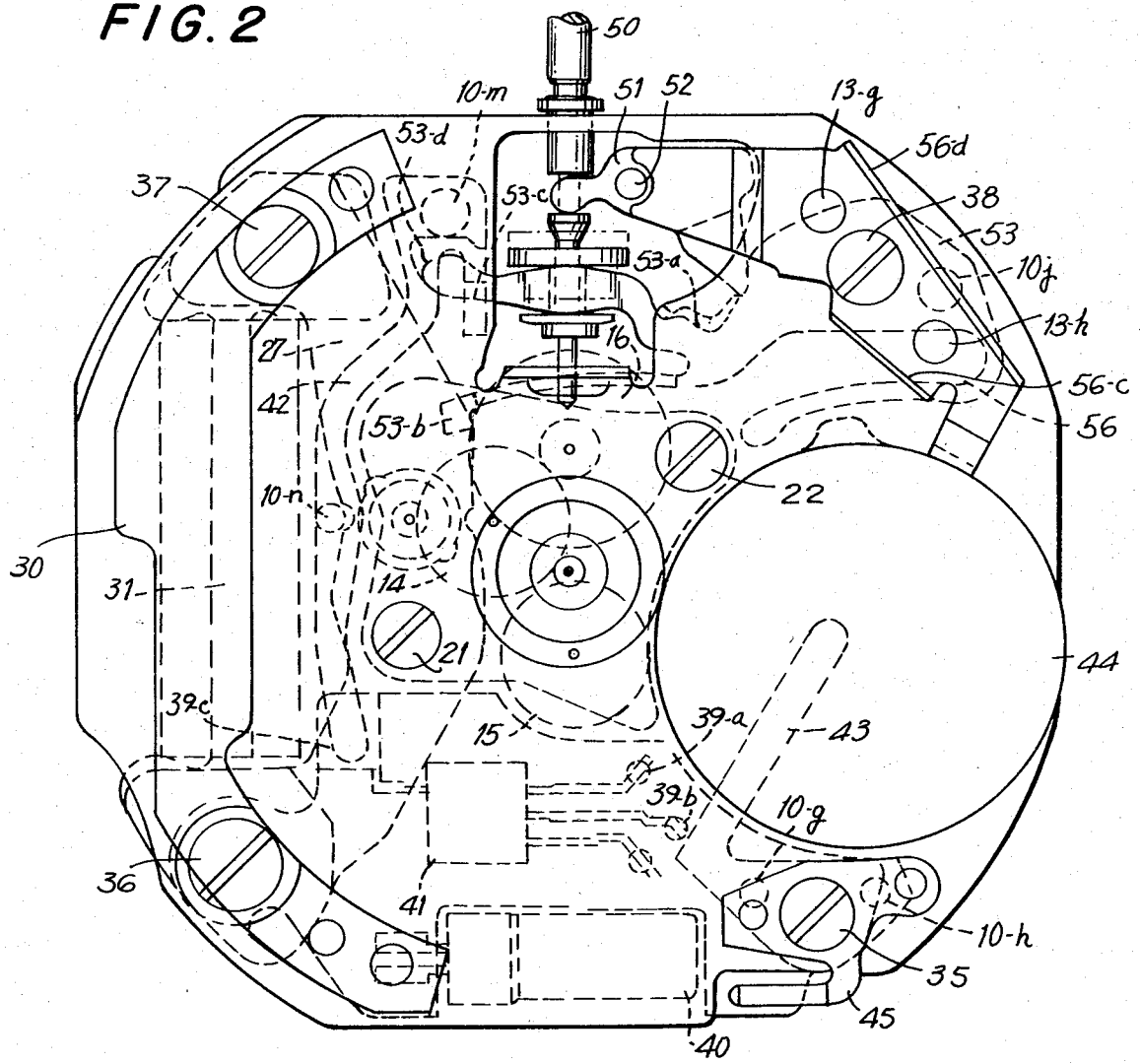
FIG. 2 is a top view of an assembled timepiece in accordance with this invention with some parts omitted.

The circuit portion of the timepiece is described with particular reference to FIGS. 2 and 5. The circuit block 34 includes an elongated plastic plate on which a quartz crystal vibrator 40 and a MOS integrated circuit 41 are mounted. The circuit block 34 is positioned by the guidance of tubes 28,10*h* connected on the bottom plate 10 so as to be held between the plastic portions of the bottom plate 10 and the bridge 13. Timing accuracy is regulated by selectively cutting off the logic regulation wiring portion from the integrated circuit 41 by means of the portions 39*a*, or 39*b*, etc. In the circuit portion, there is a serious potential problem that timing accuracy of the quartz crystal vibrator may be varied by a strong shock. In accordance with the construction (FIG. 5) of this invention, the quartz crystal oscillator is held between the concave plastic portions 10*i* on the bottom plate 10 and the concave portion 13*f* in the gear train bearing frame 13.

Also, the quartz crystal oscillator 40 is positioned at the outer periphery (FIG. 2) of the bottom plate 10. As a result, the quartz crystal oscillator holding portion 10*i* is bent to press on the quartz crystal oscillator without any gap. Therefore, it is possible to provide a quartz crystal oscillator having good resistivity against any physical shocks.

Figure 4:
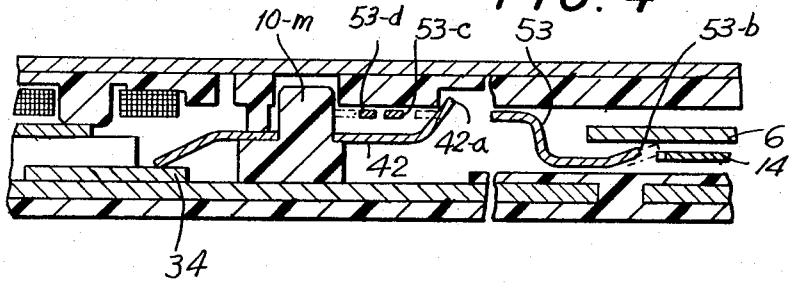
FIG. 4 is a view similar to FIG. 3 showing the circuit portion of the timepiece.

As best seen in FIGS. 2,4, the end of a reset lead plate 42 is in contact with a reset pattern portion 39*c* of the circuit block 34 in an elastic manner. The reset lead plate 42 is guided by pins 10*m*,10*n* (FIG. 2) extending from the bottom plate 10, and is held between such a pin and gear train bearing. The other end of the reset lead plate 42 is bent obliquely and is brought into contact with a yoke 53*c* by operation of a winding stem 50 so as to be connected to a positive ground in order to bring the circuit into the reset condition when the hands are set. A portion 42*a* of the reset lead plate 42 is designed to be in contact with the yoke 53 as best seen in FIG. 4 and its usual position is determined by contact with the gear train portion. Therefore, even if the bending angle is somewhat variable in production, it is possible to accurately locate the portion 42*a* by presetting the bend a little greater than is required. As a result, it is possible to actuate the reset function with the proper timing when operating the winding stem.

As best seen in FIG. 6, a battery lead plate 43 contacts the negative terminal of a battery 44 in a resilient manner. The other end of the battery lead plate 43 is anchored on the guide pins 10*h*,10*g* of the bottom plate 10 and the gear train bearing so as to be in contact with the negative pattern of the circuit plate 34. A positive lead terminal 45 is held in position by a screw 35 with a reslient portion being in contact with the positive pattern of the circuit plate 34 in an elastic manner. Connection with the positive side of the battery 44 is described hereinafter.

The component parts of the setting and calendar portion of the timepiece are now explained, and characteristics for actuation of each mechanism are described with reference to FIGS. 2, 5–8. The setting portion includes a winding stem 50 having a base portion 50*a* rotatably supported by the bottom plate 10 and by the reinforcement plate 11 of the gear train upper bridge 13. The pointed end 50*b* of the winding stem 50 is held rotatably in a horizonal tunnel 11*a* formed by bending the reinforcement plate 11 in the upper bridge 13. Conventionally, the horizontal tunnel has been recessed into the metal plate for guding the winding stem 50 rather than providing the tunnel by bending. According to such a recessing method, however, there is a disadvantage that the hole is formed by a very thin drill and the endurance of the tool cutting edge is short. As a result, manufacturing costs are raised. On the other hand in accordance with this invention, the hole for guiding of the winding stem 40 is formed in the gear train bearing reinforcement plate 11 by a pressing step, and the horizontal tunnel is formed by bending the reinforcement plate 11. As a result, it is possible to eliminate the procedures which raise the manufacturing cost. This is a rather effective construction in accordance with this invention.

The setting portion further includes a setting lever 51 interlocked to the winding stem 50 with an axis 52 being the center or rotation. The axis 52 is supported rotatably in the bottom plate 10. Also included in the setting portion is a yoke 53 wherein a click portion 53*a* is formed in a recessed and convex manner. When the click portion 53*a* engages with the setting lever 51, the yoke 53 is interlocked to the setting lever 51 with a plastic axis 10*j* of the bottom plate being the center of rotation. The yoke also comprises a setting portion 53*b* for engagement with the fifth wheel and pinion 14, and a contact portion 53*c* for engagement with the reset terminal. The setting lever 51 and the yoke 53 slide in the space between the bottom plate 10 and the bridge 13.

A clutch wheel 54 is mounted slidingly on the winding stem 50 and includes teeth 54*a* for engagement with the minute wheel 16, teeth 54*b* for engagement with a dial and teeth 54*c* for engagement with a day corrector. The clutch wheel 54 interlocks with the yoke 53. The minute wheel 16 comprises a pinion 16*a* with upper and lower guide pivots and a wheel 16*b*, the minute wheel 16 being rotatably supported between the plate 10 and bridge 13. An hour wheel 55 is made of plastic and comprises a toothed portion 55*a* for engagement with the minute pinion 16*a*, and toothed portion 55*b* for engagement with a day-date driving wheel described hereinafter. The hour wheel 55 is guided by the center pipe 13*c* of the gear train bridge 13, which is made of plastic so as to operate in the well-known manner. Because the hour wheel 55 is guided by the center pipe 13*c* of the gear train bearing 13 without touching the center wheel and pinion 19, it is possible to restrain any elements which cause a swing in the hands. Further, since the gear train reinforcement plate directly receives the force produced when thrusting the second hand, distortion of the gear train bearing etc. is prevented.

A setting lever spring 56 includes an elastic portion 56*a* for holding down the setting lever 51 described above, and another elastic portion 56*b* in contact with the side of the battery 44 to provide conductive means. A positive electric potential is fed to the above mentioned positive lead terminal 45 through the reinforcement plate 11 of the gear train bearing frame 13. The setting lever spring 56 is guided by plastic pins 13*g*,13*h* formed in the gear train bearing frame 13, and is fixed to the bottom plate 10 through the gear train bearing frame 13 by a screw 38. The setting lever spring 56 is provided with raised portions 56*c*,56*d* (FIG. 6) whereby the strength of the component is improved to increase reliability of the connection to the positive portion of the battery 44. More particularly, the strength in the horizontal direction is increased by providing the raised portions. It is possible to prevent float of the setting lever spring 56 caused by the force added at the positive conductive portion of the battery. As a result, the reliability of the connection between the setting lever spring 56 and the reinforcement plate of the frame 13 is increased. Also, the stability of contact pressure between the setting lever spring 56 and the battery 44 is increased.

Components parts of the calendar portion of the timepiece are now described with reference to FIGS. 5 nd 8. The calendar portion is located between the gear train bearing frame 13 and a dial 70.

A day corrector 60 is guided by plastic posts 13*i*,13*j* formed on the gear train bearing frame 13. A stabilized condition of the day corrector 60 is obtained by a reset spring 60*a*. A portion 60*b* of the day corrector 60 engages with the teeth 54*c* of the clutch wheel 54. An engaging portion 60*c* of the day corrector is reciprocated with the daily star by operating the winding stem 50 with the above mentioned axis in the center of the reciprocating motion to perform the correction for advancing a day. A day and date driving wheel 61 comprises integrally a date finger 61*a* and a day finger 61*b*. The day and date driving wheel 61 engages with the hour wheel 55 to operate in the well-known manner.

A date dial 62, made of metal, rotates along a plastic guide surface formed in the gear train bearing frame 13. Because the date dial 62 is thus guided by a plastic guide surface, the friction produced at the time of sliding is reduced. As a result, it is possible to eliminate conventional quality problems of various types, such as the delay or stopping of a timepiece while advancing the date. Such an advantage contributes to an increase in overall reliability.

A date dial guard 63 comprises a date jumper spring portion for controlling the date dial 62 in the horizontal direction and a date dial guard portion 64 integrated in the date jumper spring integrated with the date jumper spring by fixing means such as staking. Each operates in the well-known manner. The date dial guard 63 is guided by the posts 13*j*,13*m* formed in the gear train bearing frame 13 to be settled on the bottom plate 10 by two screws 21,22 through the gear train bearing frame 13.

A day star with dial disk 65 is guided by a drawing portion 63*a* of the date jumper spring 63. It is actuated in the known manner by a snap 66 for the day star with dial disk 65. The drawing portion of the date jumper spring is off center from the center of the timepiece as described hereinafter. Because the daily star is guided by the drawing portion of the date jumper spring, the side pressure of the daily star is not applied to the hour wheel 55. In a conventional construction for guiding the daily star, the hour wheel receives the side pressure from the daily star so that hand flapping by a hair spring may happen while driving the hands, and there are various quality problems such as stopping of the timepiece due to touching of the hour hand against the dial or the minute hand. To the contrary, in a timepiece in accordance with this invention such problems are eliminated.

In a timepiece in accordance with this invention as described above, each mechanism is simplified, and the same, or more functions than in a conventional timepiece are obtained even though there are a smaller number of component parts. Further, it is possible to assemble each part into the timepiece from one direction. Such a construction is effective for the reduction in the number of assembly steps, in ease of repair and in reliable operation.

Figure 8:
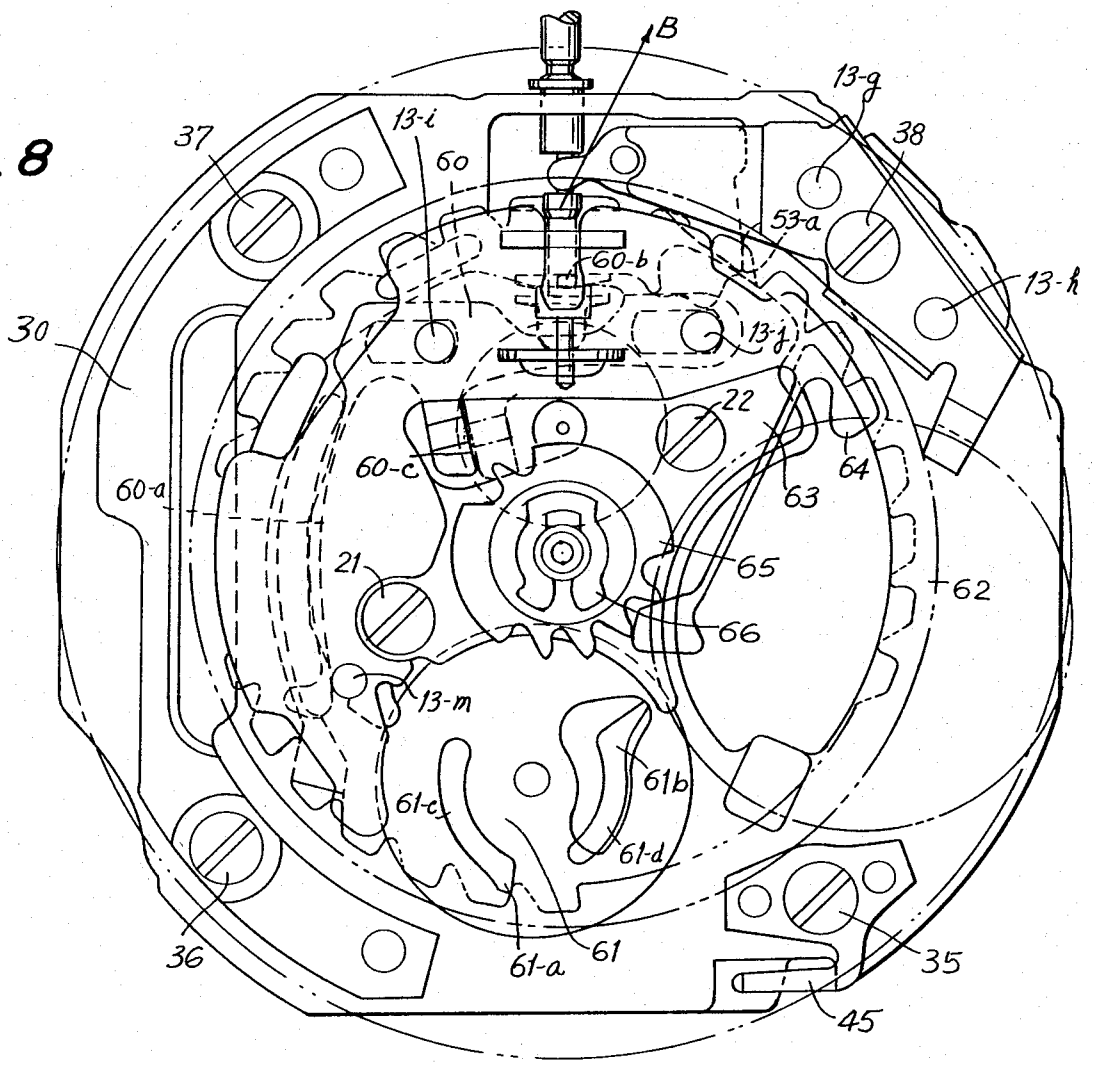
FIG. 8 is a view similar to FIG. 2 showing setting and calendar portions of the timepiece.

Actuation characteristics of the setting and calendar portions are now described with reference to FIGS. 2,5 and 8. A first position of the winding stem 50 is shown in FIG. 7. This is the normal carrying condition of the timepiece. A second position of the winding stem 50 for setting the day and date is shown in FIGS. 5–7, which are side sectional views. As best seen in FIG. 8, in the first position of the winding stem 50, a click portion 53*a* of the yoke 53 and the setting lever 51 are meshed. The teeth 54*a*,54*b*,54*c* of the clutch wheel 54 are in position so as not to be engaged with the minute wheel, daily dial nor day star with dial disk, respectively. Thus, the hour wheel 55 is in a free position, even operation of the winding stem 50 having no influence on the actuation of the timepiece.

Next, the calendar setting condition is described wherein the winding stem 50 is pulled out one step. When taking out the winding stem by one step, the setting lever 51 and yoke 53 actuate in the well-known manner. The yoke end 53*d* is positioned by contact with the plastic axis 10*m* to establish the position of the hour wheel 55 (FIG. 2). In this embodiment the teeth 54*b* of the clutch wheel 54 and the date dial 62 are meshed, while the teeth 54*c* of the clutch wheel 54 and the day corrector 60 are meshed (FIG. 3). When the winding stem 50 is turned to the right, the date dial rotates in a counterclockwise direction to readily perform correction of dates. Although the teeth 54*c* of the clutch wheel 54 are also engaged with the day corrector 60, when the day corrector is given an upward force indicated by the arrowhead A (FIG. 7), the teeth 54*c* of the clutch 54 are released from engagement with the day corrector 60 through the shape of the slanting surface of the teeth 54*c* and the resilient portion of the day corrector to prevent actuation of the day corrector 60.

When turning the winding stem 50 in the left direction, the engaging portion 60*c* of the day corrector 60 with the daily star, is put into rectilinear motion to engage with the daily star, whereby correction of a day is performed. When the engaging portion of the day corrector 60 with the clutch wheel 54 is out of the locus of the tooth 54*c* of the clutch 54, the day corrector returns to its normal position under the influence of the reset spring. Although the teeth 54*b* of the clutch wheel 54 are also engaged with the day corrector 60, the date dial is removed in the direction indicated by the arrowhead B (FIG. 8) by the slanting surface of the teeth 54*b* and the shape of the rear surface of the date dial 62. As a result, the teeth 54*b* are released from engagement with the date dial 62 to prevent the date dial from rotating in a reverse (clockwise) direction. In this embodiment, the date dial is removed in the horizontal direction, but there is no contact betwen the date dial and the day star with dial disk. There is no contact because the day star of the dial disk guiding portion is off-centered toward the direction to which the date dial is removed with respect to the center of the timepiece.

Next, correction for advancing the day and date in the day and date forwarding condition is described.

Conventionally, various methods have been applied to the securing mechanism for correction for advancing the day and date in the day and date forwarding condition. However, according to these conventional methods, a large number of component parts are required, the structure is complicated so as to be unreliable, and there are various disadvantages such as damage occurring to the parts.

To the contrary, in a timepiece in accordance wih this invention, the securing mechanism includes the day finger and the date finger which are made of plastic as described above, including elastic portions 61*c*,61*d*, respectively. These day and date fingers are meant to be outside of the locus of the date dial or daily star during the correction of date in the date forwarding condition or the correction of the day in the day forwarding condition. Therefore, there are no disadvantages. During the correction of day in the date forwarding condition, engagement between the date dial and the tooth 54*b* of the clutch wheel 54 is released in the plane direction, as described above. As a result, there is no force generated for turning back the day.

Next, in a condition wherein the winding stem is taken out one further step, the teeth 54*a* of the clutch wheel are engaged with the minute wheel to provide a hand-settable condition as is well known. Referring to the minute wheel 16, it comprises a pinion having upper and lower guiding pivots and a toothed wheel. It is rotatably supported by the bottom plate 10 and the bridge plate 13 as described above. Therefore, it is possible to reduce the swing of the toothed minute wheel as compared with the swing in a conventional structure wherein the length of the guide contact is shorter. As a result, the engagement between the teeth 54*a* of the clutch wheel and the toothed wheel of the minute wheel is stabilized. Also, it is possible to improve the impression the user receives when turning the hands and to prevent the gear train from being out of place during the turning of a hand. Further, since the minute wheel, as well as the gear train portion, is rotatably supported by upper and lower pivots between the bottom plate 10 and the gear train plate 13, the loss of torque due to friction is reduced, compared with a conventional structure. Thus, a timepiece of extremely high quality is provided.

In accordance with this invention, the sliding parts, day corrector, date dial, day and date driving wheel, yoke and setting lever etc. take advantage of the characteristics of plastic used in the bottom plate 10 and in the upper frame bridge 13. For example, the low friction coefficient and the freely shaped characteristics of the plastic are used to advantage. Contacts between components are provided only in necessary sliding portions to reduce the friction resistance. Therefore, a timepiece of higher quality is realized.

In summary, the basic construction of a timepiece, structure, operation and characteristics of a gear train, motor, circuit and setting and calendar portions in accordance with this invention, have been described. The timepiece in accordance with this invention comprises a bottom plate 10 and an upper bearing bridge or plate 13 wherein metal plates are inserted in a plastic member. The fabrication of parts or a fixed construction using the characteristics of plastic are adapted. The freely shapeable characteristic of plastic is utilized to provide improvements for making an easier assembly and increasing the reliability. Further, it is possible to provide a construction of a timepiece wherein each part from the gear train to the calendar portion can be assembled from one direction.

As a result, the cost of manufacturing the bottom plate 10 and gear train bearing plate 13, which is a major part of the cost of timepiece components, is reduced remarkably. Further, an integrated line for automatic assembly from the bottom plate 10 and gear train to calendar and case portions is realized. Mass production of a low cost analog timepiece is achieved. Moreover, since only the calendar portion is disposed between the gear train bearing frame 13 and the dial 70, even when producing a noncalendar timepiece, parts are removed and there is no necessity for changing parts of the timepiece. Thus, this invention has another advantage in that the same parts are used for various types of timepieces and the most suitable model can be provided for each application.

Moreover, as described above, the backside of the bottom plate 10, that is, the opposite side from the side to which parts are positioned, is made flat (FIG. 3) and a holding jig when inserting parts is not required. There are no recessed and convex portions on the backside and a fine external appearance for a timepiece can be provided.

An alternative construction of a timepiece in accordance with this invention is now described with reference to FIGS. 9 through 15. Various frames for an analog timepiece using a plastic resin have been considered, however, as stated above, the frames, that is, the lower plate and upper frame, plate or bridge for the timepiece, in particular for a wristwatch, need a precision which has not been achieved in plastic in the prior art. The large temperature coefficient of the plastic resin is greater than that of metal and dimensional changes due to temperature variations have been significant in the prior art. Additionally, the conventional frame contemplated for plastic construction has been low in rigidity.

Figure 9:
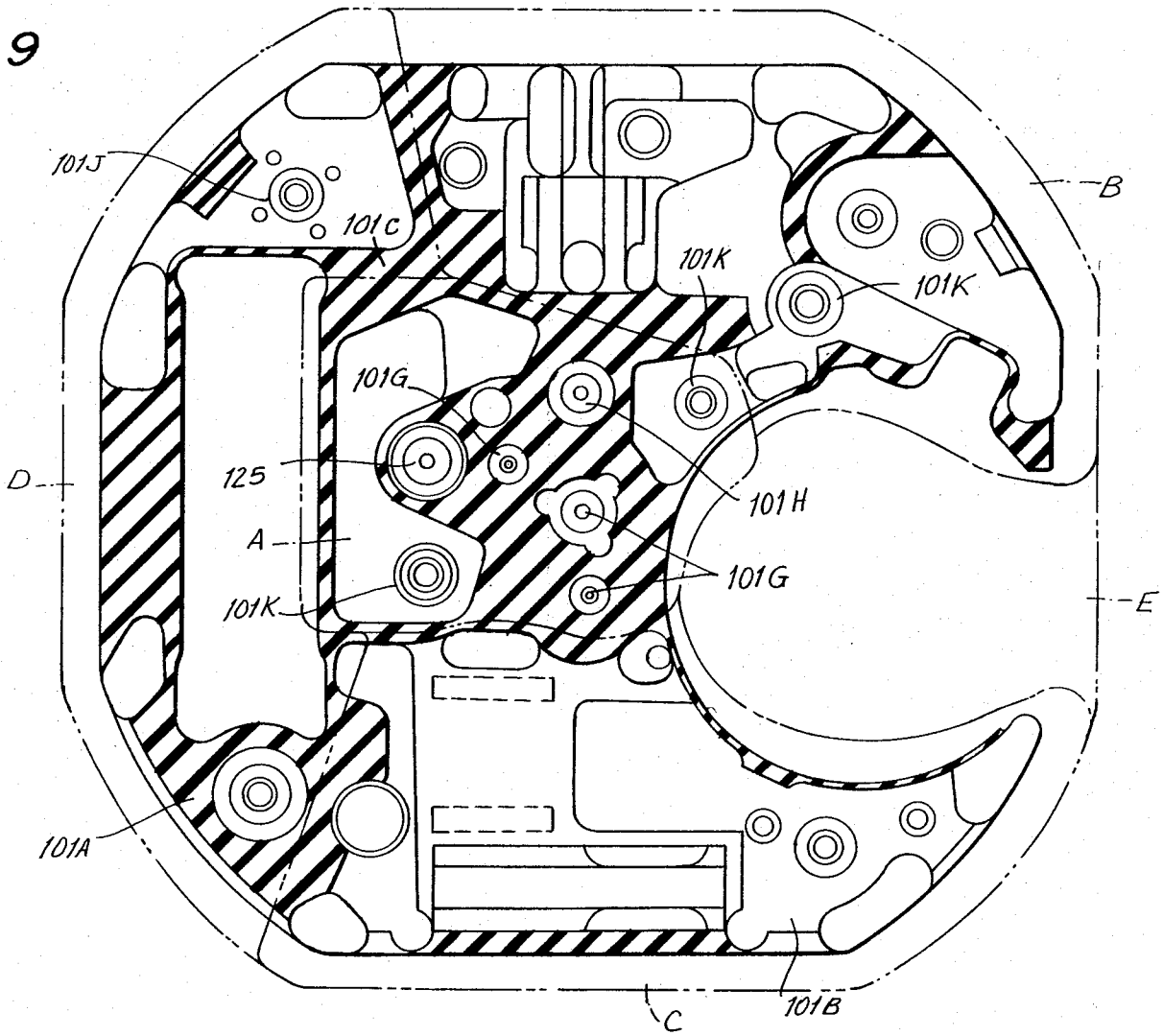
FIG. 9 is a plan view of the obverse side of an alternative embodiment of a plate for a wristwatch in accordance with this invention.
Figure 10:
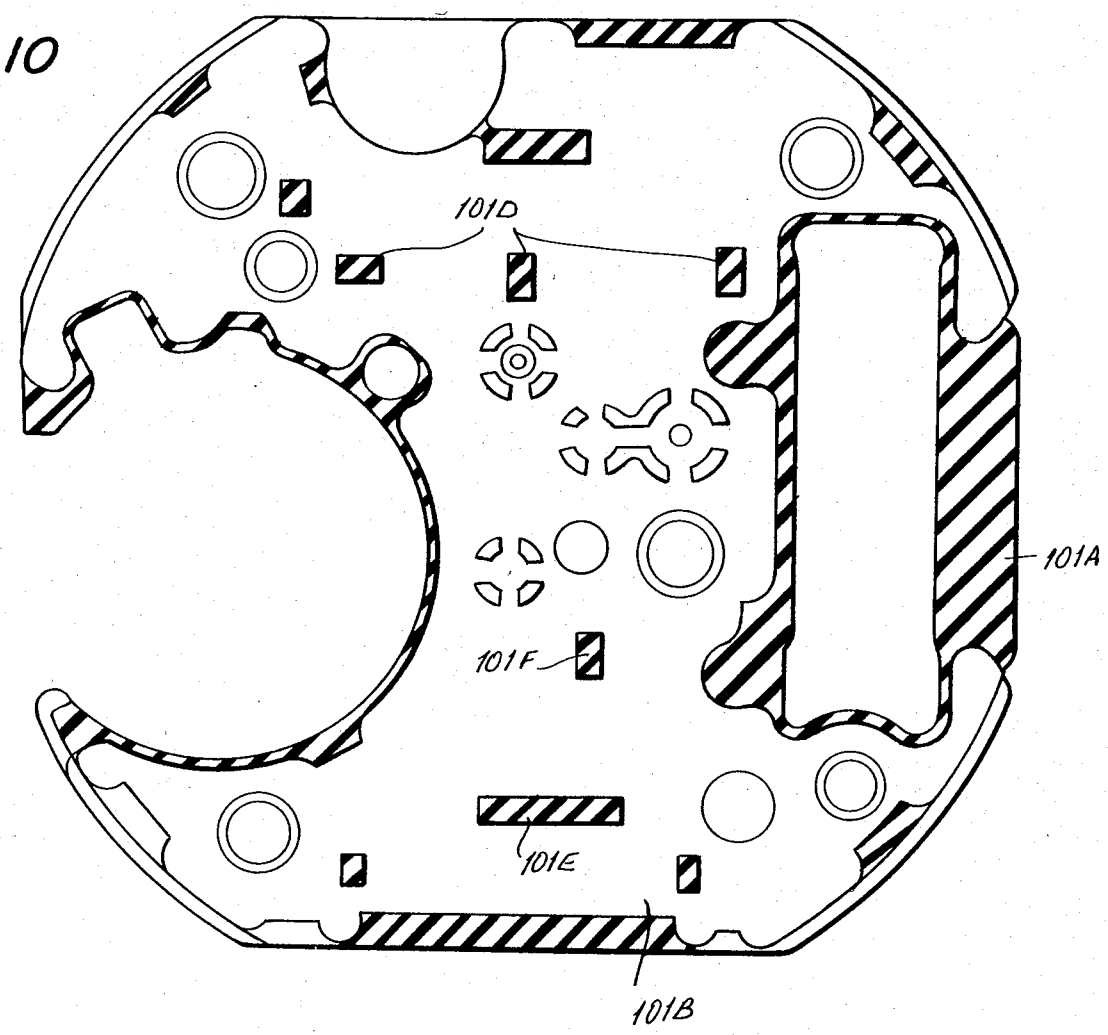
FIG. 10 is a plan view of the reverse side of the wristwatch plate of FIG. 9.
Figure 11:
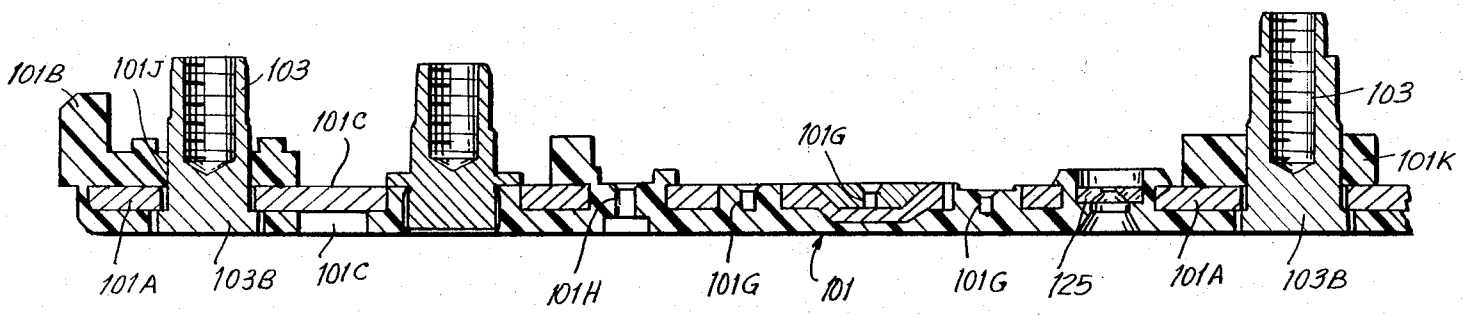
FIG. 11 is a side sectional view of the plate of FIGS. 9 and 10.
Figure 13:
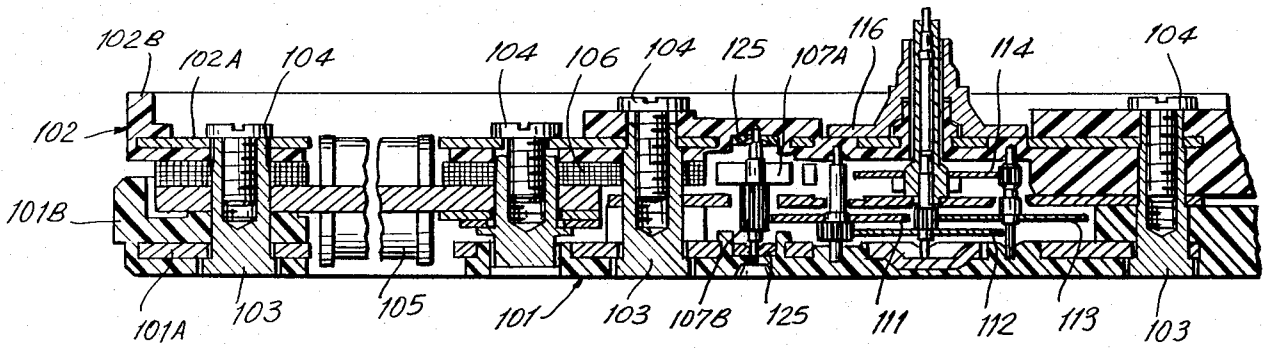
FIG. 13 is a partial sectional view of the motor and gear train portions of the timepiece of FIG. 12.
Figure 12:
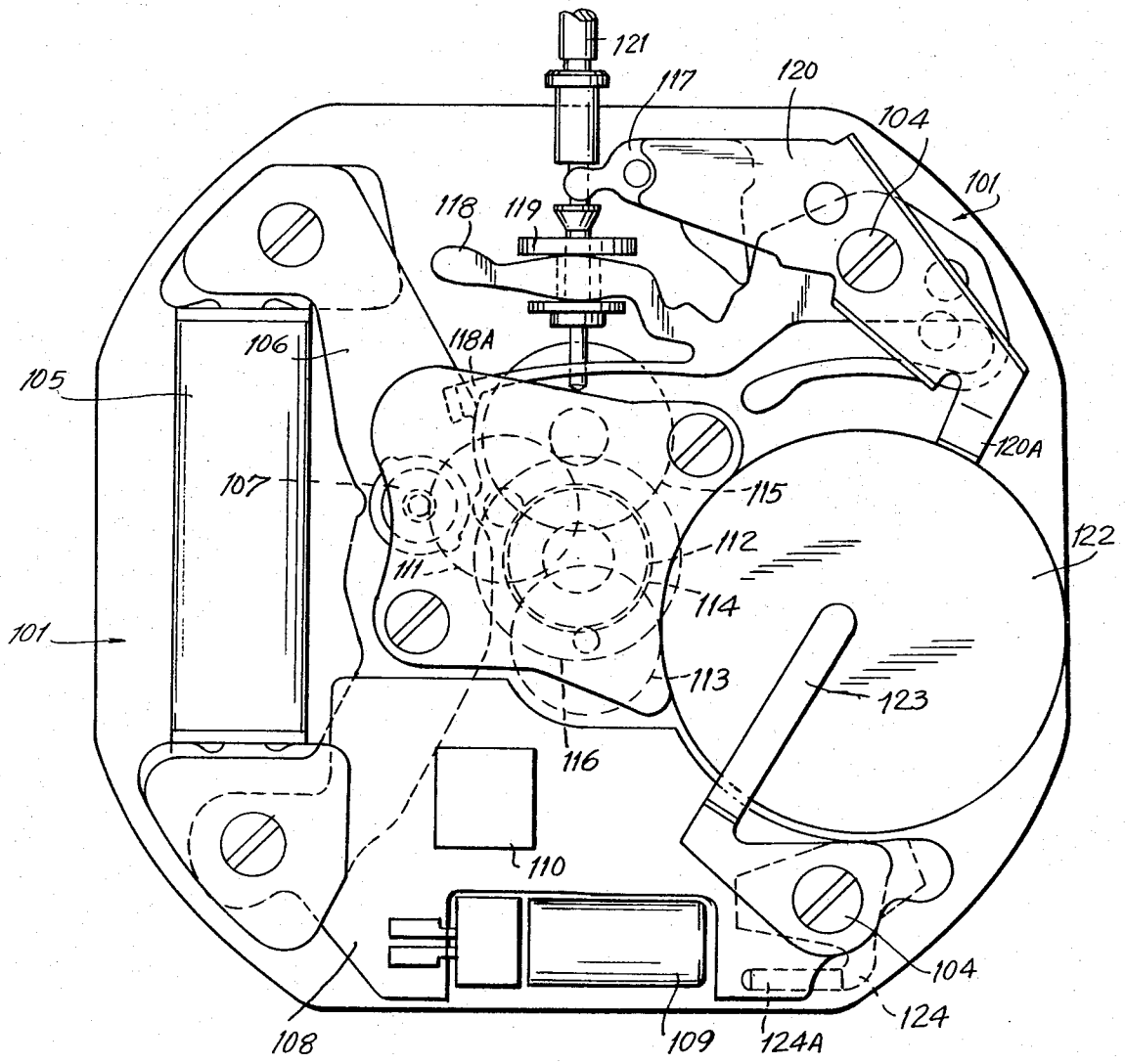
FIG. 12 is a plan view of an assembly of an analog type electronic timepiece including the frame of FIGS. 9–11.

In the timepiece in accordance with this invention described above, a metal plate has been inserted in the plastic frame to increase the stiffness and to give greater control of dimensional tolerances. Also a timepiece in accordance with this invention overcomes the difficulties of the prior art by forming the plastic/metal frame in portions which correspond to the functional portions of the timepiece. Moreover, the frames are formed having plastic resin including the holes, shafts and the like which are mechanically needed for the completed timepiece. FIGS. 9 and 10 are plan views showing an alternative embodiment of the lower frame for a timepiece in accordance with this invention. FIG. 9 is a plan view of the obverse side and FIG. 10 is a plan view of the reverse side respectively. FIG. 11 is a partial sectional view of the frame of FIGS. 9 and 10 and FIG. 12 is an assembly plan view of an analog electronic timepiece in accordance with this invention which uses the frame for the timepiece in accordance with this invention (FIGS. 9–11). FIGS. 13–15 are partial sectional views of an assembled timepiece of FIG. 12.

An analog electronic timepiece per se is already known and described in some detail above, so its construction is only briefly explained again herein as required. With reference to FIGS. 12–15, a plate 101 of the timepiece frame is formed with concave and convex plastic portions around a metal plate 101A by applying a plastic resin 101B onto the metal plate 101A. A gear train bridge 102 is another plate wherein the concave and convex portions are formed by a plastic resin 102B on a metal plate 102A in the same manner of construction as the plate 101. Various component parts of a timepiece in accordance with this invention are positioned between the above mentioned gear train bridge 102 and the lower plate 101. The bridge 102 and plate 101 are fixed together, using several metal tubes 103 which are rigidly attached to the plate 101, by means of bridge screws 104 which extend through the bridge 102 to engage the tubes 103.

A motor portion is comprised of a coil block 105 which is wound around a highly permeable material, a stator 106 which is also comprised of a highly permeable material, a permanent magnet 107A connected to a rotor 107 which has a pinion 107B engaged with a gear train. The rotor 107 is rotated by action of the electromagnetic fields produced by the coil block in response to output signals of a circuit block which includes a quartz crystal oscillator 109 and a MOS integrated circuit 110 on a circuit board 108.

The gear train portion of the timepiece in accordance with this invention includes a fifth wheel and pinion 111 which engages with the above mentioned rotor pinion 107B, a sweep second wheel and pinion 112, a third wheel and pinion 113, a center wheel and pinion 114, a minute wheel 115 and an hour wheel 116. The timepiece displays the second, minute, hour by the sweep second wheel and pinion, the center wheel and pinion, and the hour wheel respectively.

A setting mechanism portion is composed of a setting lever 117, a yoke 118, a clutch wheel 119, a setting lever guard 120 and a winding stem 121. Then, as is commonly known, the setting mechanism portion is engaged in the above mentioned clutch wheel 119 and minute wheel 115 by drawing out the winding stem. Thus, there is the capability to correct the minute and hour by rotating the winding stem 121. When correcting time, a spring portion 118A of the yoke 118 engages with a peripheral gear of the above mentioned fifth wheel and pinion 111 and the time is corrected without rotating the second wheel as a result of a slip or friction construction between the gear and the shaft of the center wheel and pinion 114. These corrections and adjustments are substantially as described in the embodiment above.

A battery portion of the timepiece includes a battery negative lead plate 123 which electrically connects to the cathode region of a button-type battery 122. The battery portion also includes a U-spring portion 120A of the above mentioned setting lever guard 120 which engages with the outer peripheral cylindrical portion, that is, the anode region of the battery 122. The battery negative lead plate 123, having one end directly lapped over a circuit board pattern of the circuit block, conducts by being sandwiched between the plate 101 and gear train bridge 102. On the other hand, the setting lever guard 120 which is a positive lead, is positioned directly overlapping the metal plate 102A of the gear train bridge 102. A resilient spring portion 124A of the positive lead terminal 124, which is set with a screw 104 to the metal plate 102A in the same manner as the setting lever guard, connects to a circuit pattern on the circuit board. The metal plate 102A also connects to the metal plate 101A of the lower plate 101 through the tube 103 for the bridge screws 104. This electrical connection between the plates prevents static electricity from accumulating locally in the plastic frame.

In the FIGS. 9–12, the upper gear train bridge 102, which is one major portion of the timepiece frame, has been omitted for the sake of clarity in illustration.

The construction of the baseplate 101 which aligns and supports the various component parts, and the frame of the gear train bridge 102 are most important. As shown in FIGS. 9–11, which illustrate the lower plate 101, the frame work of the timepiece in accordance with this invention has sufficient stiffness by inserting and forming the metal plate 101A integrally into the plastic resin. The accuracy in locating the various parts, on the plates 101,102, namely, the bearing holes, guide pin holes for the gear train, and so on, is important and is controlled by the concave and convex curvatures of the plastic resin which are positioned on the metal plates. In this invention, the plan location of the various holes and pins is controlled in response to the molding shrinkage by separating the plastic resin in portions which are identified in FIG. 9 by the broken lines. These portions are the gear train portion A, the setting mechanism portion B, the circuit portion C, the motor portion D, and the battery portion E. These portions of plastic roughly correspond with the respective functional blocks in the timepiece construction described above and substantially are separated by metal. Additionally, separating the plastic resin as much as possible with metal is a means for obtaining positional accuracy. These means for separating can bring about ordinary effects by making a separating slot 101C having a thin wall of plastic at the base, and can bring about greater effects by constructing in such a way that a metal face is exposed on the surfaces as shown in FIGS. 9 and 10 by the shaded portions.

As is known, when molding with plastic resin, a molding tool is concave and convex in portions just opposite to the completed product. In the construction in accordance with this invention, the vertical position of the metal plate can be held positively by clamping the exposed portions of the metal plate 101A in the molding tool, and at the same time the accuracy of various locations of the completed frame can be achieved by preventing the metal plate from deforming in the molding tool because of the plastic resin injection pressure at the time of molding. It is desirable that the separating slots 101C exposing the metal on the face and back surfaces of the metal plate, are opposite to each other in almost the same shape and the thickness and having the metal plate therebetween. However, in the practical embodiment as shown in FIG. 13, which is an assembly sectional view of a timepiece in accordance with this invention, the obverse face is thick walled with plastic and the reverse is thin walled. Partial slots 101D, 101E and 101F, and so on, positioned on the reverse side for holding the metal plate 101A therebetween, are used corresponding to the separating slot 101C on the obverse side, and a similar effect can be obtained.

Additionally, the plan position of the gear train portion is very important. For example, in case of a wristwatch, the gear module is very small, that is, approximately 0.03 through 0.10. The engaging efficiency of the gears is easily reduced and the mechanism can come to rest by a dispersion of the center distances of the wheels and pinions. An allowable value of dispersion of such a center distance is about 0.02 millimeters.

In the gear portion in accordance with this embodiment, the pivot bearing holes 101G and 101H, etc., the plates 101 and 102 of the above and below frames, and the guiding pin hole 101K of the gear train bridge, and so on are composed of plastic resin. The metal plate 101A is positioned in the neighborhood of the above mentioned various holes, so a more accurate plan position is secured thereby. It is very disadvantageous to align the metal plate by the plastic molding tool and to increase the dispersion factor of location accuracy by using both a metal plate hole and the plastic resin. Additionally, with respect to coast, there is no sense in applying plastic resin if the metal plate is also to be processed. Moreover, in accordance with this invention it is possible to make the pivots non-oiling by using a plastic resin bearing and a stable timepiece can be provided.

Jeweled bearings 125 are used to support the rotor 107 at its upper and lower pivots. Locational accuracy is obtained by forming the supporting hole for the jewel bearing 125 with plastic in the same way as the pivot hole 101G, and so on, and by positioning the jeweled bearing on an equal plane as the metal plate 101A within the thickness of the metal plate 101A. Then a tube 103 for a bridge screw is aligned with plastic resin in the same way as the pivot hole and the bearing in the plan view. A collar portion 101B of the tube 103 for the bridge screw engages an exposed surface of the metal plate 101A rather than engagement with plastic which would be damaged when the screw is tightened. The collar portion 103B is positively prevented from rotating by knurling or chamfering a side surface.

A material having a low coefficient of thermal expansion and a low mold shrinkage factor is desirable as the plastic resin. At present, for example, polycarbonate, polyphenylene oxide, polyphenylene sulfite, polyacetal, and the like are applicable. The above mentioned various resin with fluorine plastics are appropriate also in order to obtain the further effect as an oil-free bearing.

Whereas the FIGS. 9–12 relate primarily to the frame 101, the construction of the gear train bridge 102 is quite similar. The components of the timepiece which are mounted between and beyond the frames 101,102 are similar to those described in relation to the embodiment of FIGS. 1–8 and are not described again herein for that reason.

In summary, in the frame for a timepiece in accordance with this invention, concave and convex portions are formed with a plastic resin on a metal plate, and the plastic portion is divided to accommodate the functional blocks of a wristwatch. Therefore, the holes for pivoting the wheels and pinions are concentrated in one area and dispersion of the center distances between the wheels and pinions can be made very small. In addition, warpage is made small by forming the block in divided portions such that the spans of plastic without metal reinforcement are reduced, and the metal plate is exposed and used to achieve positive reference positioning. Thus, a wristwatch having stable quality is obtained. Moreover, with respect to the holes and the like, their accuracy is improved by forming all of them with plastics and auxiliarily using the metal plate. Also, a oil-free bearing can be formed using plastics.

It will thus been seen that the objects set forth above, among those made apparent from the preceding description are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

What is claimed is:

1. An electronic wristwatch driven by a stepping motor comprising:

at least a first frame and a second frame, said first and second frames being formed of metal plates with plastic layers integrated to said metal plates, said plastic layers being substantially separated, in a plan view, into concave and convex portions, the concave and convex portions at each said separated plan view portion being adapted to mount components substantially of a functional block of said wristwatch;

a gear train including a rotor portion of said stepping motor for driving said display, said gear train being positioned between said first and second frames;

a ring-shaped date dial and a date dial guard disposed between a dial and one of said first and second frames; said date dial guard supporting said ring-shaped date dial, said dial guard being a metal plate, said first and second frames and said date dial guard each having a hole, said holes being concentric;

a threaded tube fixed in the concentric hole of the other one of said first and second frame;

a bridge screw passing through said concentric holes from the side of said dials to engage said threaded tube, said first and second frames and said date dial guard being supported together in common by said bridge screw when said gear train and said rotor are arranged on the concave portion of said plastic layer, at least a part of the convex portion being used as a spacer between said two frames, the heads of said threaded tube and said bridge screw being respectively overlapped with the metal plate in the frame and the metal of the dial guard so that the axial forces created by the bridge screw are supported by the metal of the frame and dial guard.

2. An electric wristwatch as claimed in claim 1 wherein said plastic layer is distributed on said metal plate so as to leave areas of exposed metal on at least one face of said plate.

3. An electric wristwatch as claimed in claim 1, wherein said analog timepiece includes a gear train, at least one gear train axle hole and a gear train bridge guiding hole being formed in said plastic layer.

4. An electric wristwatch as claimed in claim 4, and further comprising a bearing, said bearing being supported in said plastic layer and located in an opening in said metal plate.

5. An electronic wristwatch as claimed in claim 1, wherein said gear train is adapted to drive each of an hour, minute and second hand coaxially, and further comprising an intermediate bridge disposed between said first frame and said second frame, said gear train including a center wheel and pinion guided and held between said intermediate bridge and said frame, and a fourth wheel and pinion held between said intermediate bridge and said first frame coaxially with said center wheel and pinion, the shake of said fourth wheel and pinion being determined by abutment with an end of said center wheel and pinion.

6. An electronic wristwatch as claimed in claim 5, wherein said plastic layer is adapted to guide and hold said forth wheel and pinion for rotary motion, said fourth wheel and pinion being constrained laterally in the direction of said wheel diameter by plastic surfaces of said plastic layer, the pinion of said fourth wheel and pinion being constrained in the longitudinally thrust direction by said metal plate.

7. An electronic wristwatch as claimed in claim 1, wherein said gear train includes: a minute wheel guided and rotatably supported by said second frame and said first frame, and an hour wheel disposed on the outer dial side of said second frame, said minute wheel being engaged with said hour wheel through an opening of said second frame.

8. An electronic wristwatch as claimed in claim 7, wherein said hour wheel is rotatably supported by a plastic pipe extending from said second frame.

9. An electronic wristwatch as claimed in claim 1 and further comprising a winding stem, a portion of said metal plate being exposed, said winding stem being guided by said exposed portion of said metal plate.

10. An electronic wristwatch with dial and case comprising at least first and second frames holding a gear train for display therebetween, said first frame being provided adjacent the dial of said wristwatch and said second frame being provided on the side of the back of said case, said second frame being formed of a metal plate covering generally the entire movement of said wristwatch and a plastic layer integrally joined to said metal plate, said plastic layer including concave and convex portions and a radial shaft bearing portion for supporting shafts of said gear train, and a hand setting shaft extending generally parallel to said frames, and a bearing in said plastic layer for said hand setting shaft being provided reinforced by said metal plate to which at least said second frame is connected, said bearing supporting said hand setting shaft in the direction of thrust when said setting shaft is rotated for hand setting.

* * * * *